US010697046B2

(12) United States Patent
Sanaty-Zedah et al.

(10) Patent No.: US 10,697,046 B2
(45) Date of Patent: Jun. 30, 2020

(54) HIGH-PERFORMANCE 5000-SERIES ALUMINUM ALLOYS AND METHODS FOR MAKING AND USING THEM

(71) Applicant: NanoAL LLC, Skokie, IL (US)

(72) Inventors: Amirreza Sanaty-Zedah, Milwaukee, WI (US); Nhon Q. Vo, Skokie, IL (US); Davaadorj Bayansan, Glenview, IL (US); Evander Ramos, Evanston, IL (US)

(73) Assignee: NanoAL LLC, Ashland, MA (US)

( * ) Notice: Subject to any disclaimer, the term of this patent is extended or adjusted under 35 U.S.C. 154(b) by 240 days.

(21) Appl. No.: 15/642,798

(22) Filed: Jul. 6, 2017

(65) Prior Publication Data

US 2018/0010215 A1 Jan. 11, 2018

Related U.S. Application Data

(60) Provisional application No. 62/359,556, filed on Jul. 7, 2016.

(51) Int. Cl.

| | |
|---|---|
| ***C22C 21/06*** | (2006.01) |
| ***C22F 1/047*** | (2006.01) |
| ***C22C 1/02*** | (2006.01) |
| ***C22C 21/10*** | (2006.01) |
| ***C22F 1/04*** | (2006.01) |
| ***C22F 1/053*** | (2006.01) |

(52) U.S. Cl.

CPC ..... *C22C 21/06* (2013.01); *C22C 1/026* (2013.01); *C22C 21/10* (2013.01); *C22F 1/04* (2013.01); *C22F 1/047* (2013.01); *C22F 1/053* (2013.01)

(58) Field of Classification Search

CPC ..... C22C 21/06; C22C 21/10; C22C 1/026; C22F 1/047; C22F 1/053

See application file for complete search history.

(56) References Cited

U.S. PATENT DOCUMENTS

| | | | |
|---|---|---|---|
| 3,551,143 | A | 12/1970 | Marukawa et al. |
| 3,807,969 | A | 4/1974 | Schoerner et al. |
| 5,087,301 | A | 2/1992 | Angers et al. |
| 5,327,955 | A | 7/1994 | Easwaran |
| 5,449,421 | A | 9/1995 | Hamajima et al. |
| 5,976,214 | A | 11/1999 | Kondoh et al. |
| 6,149,737 | A | 11/2000 | Hattori et al. |
| 6,592,687 | B1 | 7/2003 | Lee et al. |
| 6,918,970 | B2 | 7/2005 | Lee et al. |
| 8,323,373 | B2 | 12/2012 | Haynes, III et al. |
| 8,778,099 | B2 | 7/2014 | Pandey |
| 9,453,272 | B2 | 9/2016 | Vo et al. |
| 2001/0025675 | A1 | 10/2001 | Haszler et al. |
| 2003/0192627 | A1 | 10/2003 | Lee et al. |
| 2004/0091386 | A1 | 5/2004 | Carroll et al. |
| 2004/0256036 | A1 | 12/2004 | Van Der Hoeven et al. |
| 2004/0261922 | A1 | 12/2004 | Van Der Hoeven et al. |
| 2010/0143177 | A1 | 6/2010 | Pandey et al. |
| 2011/0017359 | A1 | 1/2011 | Pandey |
| 2012/0000578 | A1 | 1/2012 | Wang et al. |
| 2013/0199680 | A1 | 8/2013 | Apelian et al. |
| 2013/0220497 | A1 | 8/2013 | Huskamp et al. |
| 2015/0284825 | A1 | 10/2015 | Norman et al. |
| 2016/0271688 | A1 | 9/2016 | Wuest et al. |
| 2017/0058386 | A1 | 3/2017 | Vo et al. |

FOREIGN PATENT DOCUMENTS

| | | | |
|---|---|---|---|
| CN | 103866167 | A | 6/2014 |
| EP | 0 558 957 | A2 | 9/1993 |
| EP | 2 241 644 | A1 | 10/2010 |
| JP | 2008-025006 | A | 2/2008 |

OTHER PUBLICATIONS

M. C. Carroll et al., "Effects of Minor Cu Additions on a Zn-Modified Al-5083 Alloy," *Materials Science and Engineering A*, vol. 319-321, pp. 425-428 (2001).

M. C. Carroll et al., "Effects of Zn Additions on the Grain Boundary Precipitation and Corrosion of Al-5083 Alloy," *Scripta Mater*, vol. 42, pp. 335-340 (2000).

M. C. Carroll et al., "Optimum Trace Copper Levels for SCC Resistance in a Zn-Modified Al-5083 Alloy," *Materials Science Forum*, vol. 396-402, pp. 1443-1448 (2002).

N. Kumar et al., "Critical Grain Size for Change in Deformation Behavior in Ultrafine Grained Al-Mg-Sc Alloy," *Scripta Materialia*, vol. 64, pp. 576-579 (Dec. 4, 2010).

N. Kumar et al., "Microstructure and Mechanical Behavior of Friction Stir Processed Ultrafine Grained Al—Mg—Sc Alloy," *Materials Science and Engineering A*, vol. 528, pp. 5883-5887 (2011).

N. Kumar et al., "Thermal Stability of Friction Stir Processed Ultrafine Grained Al—Mg—Sc Alloy," *Materials Characterization*, vol. 74, pp. 1-10 (2012).

Kinga A. Unocic et al., "Grain Boundary Precipitate Modification for Improved Intergranular Corrosion Resistance," *Materials Science Forum*, vol. 519-521, pp. 327-332 (Jul. 15, 2006).

Non-Final Office Action dated May 4, 2016 for U.S. Appl. No. 14/645,654, 8 pages.

Non-Final Office Action dated Dec. 31, 2018 for U.S. Appl. No. 15/263,011, 5 pages.

Final Office Action dated Aug. 8, 2019 for U.S. Appl. No. 15/263,011, 7 pages.

Extended European Search Report dated Feb. 15, 2017 for European Application No. 15760733.4, 9 pages Extended European Search Report dated Sep. 23, 2019 for European Application No. 19172652.0, 8 pages.

International Search Report and Written Opinion dated Jun. 25, 2016 for International Application No. PCT/US2015/020218, 14 pages.

International Search Report and Written Opinion dated Jun. 15, 2018 for International Application No. PCT/US2018/020899, 10 pages.

(Continued)

*Primary Examiner* — C Melissa Koslow

(57) ABSTRACT

5000 series aluminum wrought alloys with high strength, high formability, excellent corrosion resistance, and friction-stir weldability, and methods of making those alloys.

32 Claims, 4 Drawing Sheets

(56) References Cited

OTHER PUBLICATIONS

Berezina, A. L. et al., "Decomposition Processes in the Anomalous Supersaturated Solid Solution of Binary and Ternary Aluminium Alloys Alloyed with Sc and Zr," Acta Physica Polonica A, 122(3):539-543 (2011).
Booth-Morrison, C. et al., "Effect of Er additions on ambient and high-temperature strength of precipitation-strengthened Al-Zr-Sc-Si alloys," Acta Mater, 60:3463-3654 (2012).
Booth-Morrison, C. et al., "Role of silicon in accelerating the nucleation of A13(Sc,Zr) precipitates in dilute $Al_3$-Sc-Zr alloys," Acta Mater, 60:4740-4752 (2012).
Booth-Morrison, C. et al., "Coarsening resistance at 400°C of precipitation-strengthened Al-Zr-Sc-Er Alloys," Acta Mater, 59(18):7029-7042 (2011).
Fuller, C. B. et al., "Temporal evolution of the nanostructure of Al(Sc,Zr) alloys: Part 1—Chemical compositions of $A1_3(Sc_{1-x}Zr_x)$ precipitates," Acta Mater, 53:5401-5413 (2005).
Hallem, H. et al., "The formation of $A1_3(Sc_xZryHf_{1-x-y})$ dispersoids in aluminium alloys," Mater Sci Eng A, 421:154-160 (2006).
Hori, S. et al., "Effect of small addition of Si on the precipitation of Al-0.6%Zr Alloys," J Jpn Inst Light Met, 28:79-84 (1978).
Huang, H. et al., "Age Hardening Behavior and Corresponding Microstructure of Dilute Al-Er-Zr Alloys," Metallurgical and Materials Transactions A, 44A:2849-2856 (2013).
Knipling, K. E. et al., "Criteria for developing castable, creep-resistant aluminum-based alloys—A Review," Z Metallkd, 97:246-265 (2006).
Knipling, K. E. et al., "Atom Probe Tomographic Studies of Precipitation in Ai-0.1Zr-0.1Ti (at.%) Alloys," Microscopy and Microanalysis, 13:1-14 (2007).
Knipling, K. E. et al., "Nucleation and Precipitation Strengthening in Dilute Al-Ti and Al-Zr Alloys," Metallurgical and Materials Transactions A, 38A:2552-2563 (2007).
Knipling, K. E. et al., "Creep resistance of cast and aged Al-0.1Zr and Ai-0.1Zr-0.1Ti (at.%) alloys at 300—400°C," Scr Mater, 59:387-390 (2008).
Knipling, K. E. et al., "Precipitation evolution in Al—Zr and Al—Zr—Ti alloys during isothermal aging at 375425°C," Acta Mater, 56:114-127 (2008).
Knipling, K. E. et al., "Precipitation evolution in Al—Zr and Al—Zr—Ti alloys during isothermal aging at 450600°C," Acta Mater, 56:1182-1195 (2008).
Knipling, K. E. et al., "Precipitation evolution in Ai-0.1Sc, Al-0.1Zr and Ai-0.1Sc-0.1Zr (at.%) alloys during isochronal aging," Acta Mater, 58:5184-5195 (2010).
Knipling, K. E. et al., "Ambient- and high-temperature mechanical properties of isochronally aged Al-0.06Sc, Al-0.06Zr and Ai-0.06Sc-0.06Zr (at.%) alloys," Acta Mater, 59:943-954 (2011).
LeClaire, A. D. et al., "3.2.13 Aluminum group metals," Diffusion in Solid Metals and Alloys (H. Mehrer (Ed.)), Springer Materials—Landolt-Bornstein—Group III condensed Matter, 26:151-156 (1990).
Li, H. et al., "Precipitation evolution and coarsening resistance at 400°C of Al microalloyed with Zr and Er," Scr Mater, 67:73-76 (2012).
Ohashi, T. et al., "Effect of Fe and Si on age hardening properties of supersaturated solid solution of Al-Zr," J Jpn. Inst Met, 34:604-640 (1970). Abstract.
Riddle, Y. W. et al., "A Study of Coarsening, Recrystallization, and Morphology of Microstructure in Al-Sc-(Zr)-(Mg) Alloys," Metallurgical and Materials Transactions A, 35A:341-350 (2004).
Sato, T. et al., "Effects of Si and Ti Additions on the Nucleation and Phase Stability of the L12-Type Al3Zr Phase in Al-Zr Alloys," Mater Sci Forum, 217-222:895-900 (1996).
Seidman, D. N. et al., "Precipitation strengthening at ambient and elevated temperatures of heat-treatable Al(Sc) alloys," Acta Mater, 50:4021-4035 (2002).
Van Dalen, M. E. et al., "Effects of Ti additions on the nanostructure and creep properties of precipitation-strengthened Al—Sc alloys," Acta Mater, 53:4225-4235 (2005).
Wen, S. P. et al., "Synergetic effect of Er and Zr on the precipitation hardening of Al—Er—Zr alloy," Scr Mater, 65:592-595 (2011).
Zhang, Y. et al., "Precipitation evolution of Al—Zr—Yb alloys during isochronal aging," Scr Mater, 69:477-480 (2013).

HIGH-PERFORMANCE 5000-SERIES ALUMINUM ALLOYS AND METHODS FOR MAKING AND USING THEM

The present application claims the benefit of and priority to U.S. Provisional Application No. 62/359,556, filed 7 Jul. 2016.

FIELD

A series of friction-stir weldable 5000 series aluminum alloys with high strength, high formability, excellent creep resistance, and excellent corrosion resistance is disclosed.

BACKGROUND

Aluminum alloys have a wide range of applications in light weight structures in aerospace, automotive, marine, wire and cable, electronics, nuclear, and consumer products industries. Among them, aluminum 5000 series alloys are commonly used due to a combination of good mechanical properties and excellent corrosion resistance. 5000 series alloys typically are produced in the form of rolled (sheets, plates) or extrusion products and are utilized in a variety of applications such as automotive body panels, boat and ship body structures, storage tanks, pressure vessels, and vessels for land and marine structures.

An example of an Al—Mg alloy is Aluminum Association 5083 ("AA5083"), which has had a wide range of applications in automotive and marine industries for decades. It possesses a good combination of properties such as high strength, good formability, good weldability, light weight, and low cost. However, a common drawback for this alloy is the susceptibility to inter-granular corrosion (IGC), exfoliation corrosion, and stress corrosion cracking (SCC) and subsequent failure while in service. This phenomenon is called sensitization. Long term exposure of the alloy to moderate temperatures in the range of 80-200° C. can significantly deteriorate the performance of the alloy. An alternative to AA5083 for applications where corrosion resistance is critical is the Al-5454 alloy with 2.4-3 wt. % magnesium. The Mg content in this alloy is reduced to below sensitization critical content (that is at about 4 wt. %). Consequently, mechanical strength of the alloy is reduced; hence, the alloy is not capable of operating in applications where there is a demand for higher strength.

Efforts have been made to improve the corrosion resistance of AA5083 while maintaining mechanical strength. The effect of additions of minor alloying elements such as Mn, Cu and Zn has been investigated. Mn is believed to promote the inter-grain precipitation by providing heterogeneous nucleation sites. Zn is reported to improve the corrosion resistance of Al—Mg alloys by: i) promoting the precipitation of a Mg-phase inside the grains rather than along grain boundaries; and ii) formation of a new ternary phase (so called τ with composition $Mg_{32}(Al,Zn)_{49}$ along grain boundaries that is discontinuous and has a closer electropotential to the matrix. As a result, higher magnesium content can be tolerated in the alloy. Furthermore, the addition of Cu and Zn together can improve corrosion resistance. Although the mechanism is not clear, it is postulated to be similar to the effect of adding Zn alone. Cu forms $Al_2CuMg$ precipitates inside the grain which reduces the formation of a β phase along the grain boundaries. The following references describe some of the efforts in this regard:

King A. Unocic, Paul Kobe, Michael J. Mills, Glenn S. Daehn, "GRAIN BOUNDARY PRECIPITATE MODIFICATION FOR IMPROVED INTERGRANULAR CORROSION RESISTANCE", *Materials Science Forum,* 519-521 (2006) 327-332.

M. C. Carroll, P. I. Gouma, M. J. Mills, G. S. Daehn, B. R. Dunbar, "EFFECT OF ZN ADDITION ON THE GRAIN BOUNDARY PRECIPITATION AND CORROSION IN AL-5083", *Scripta Materialia,* 42 (2000) 335-340.

M. C. Carroll, R. G. Buchheit, G. S. Daehn, M. J. Mills, "OPTIMUM TRACE COPPER LEVELS FOR SCC RESISTANCE IN A ZN-MODIFIED AL-5083 ALLOY", *Materials Science Forum,* 396-402 (2002) 1443-1448.

M. C. Carroll, P. I. Gouma, G. S. Daehn, M. J. Mills, "EFFECTS OF MINOR CU ADDITIONS ON A ZN-MODIFIED AL-5083 ALLOY", *Materials Science and Engineering*, A319-321 (2001) 425-428.

Mark C. Carroll, Michael J. Mills, Glenn S. Daehn, Bruce Morere, Paul Kobe, H. S. Goodrich, "5000 SERIES ALLOYS WITH IMPROVED CORROSION PROPERTIES AND METHODS FOR THEIR MANUFACTURE AND USE", Patent Application Publication No. US 2004/0091386 A1 2004.

Job Anthonius Van Der Hoeven, Linzhong Zhuang, Bruno Schepers, Peter De Smet, Jean Pierre, Jules Baekelandt, "ALUMINUM-MAGNESIUM ALLOY PRODUCT", Patent Application Publication No. US 2004/0256036 A1 2004.

Job Anthonius Van Der Hoeven, Linzhong Zhuang, Bruno Schepers, Peter De Smet, Jean Pierre, Jules Baekelandt, "WROUGHT ALUMINUM-MAGNESIUM ALLOY PRODUCT", Patent Application Publication No. US 2004/0261922 A1 2004.

Aluminum 5000 series alloys are typically hardened through two main mechanisms: a) solid-solution strengthening by magnesium, b) strain-hardening by working (H tempers). Consequently, these alloys soften upon exposure to elevated temperatures, due to loss of strain hardening and due to grain growth which hinders their high temperature applications.

Recent efforts have been made to produce Al—Mg alloys that are capable of operating at high temperatures while maintaining other properties such as high strength, high creep resistance, good weldability, high corrosion resistance, and excellent formability. These alloys typically contain a high concentration of scandium. The high price of scandium and limited resources pose limitations to scale up and mass production which is costly for high volume applications. Some of these efforts are summarized below:

N. Kumar, R. S. Mishra, C. S. Huskamp, K. K. Sankaran, "Microstructure and mechanical behavior of friction stir processed ultrafine grained Al—Mg—Sc alloy", *Materials Science and Engineering* A 528 (2011) 5883-5887.

N. Kumar, R. S. Mishra, C. S. Huskamp, K. K. Sankaran, "Critical grain size for change in deformation behavior in ultrafine grained Al—Mg—Sc alloy", *Scripta Materialia* 64 (2011) 576-579.

N. Kumar, R. S. Mishra, "Thermal stability of friction stir processed ultrafine grained Al—Mg—Sc" *Materials Characterization,* 74 (2012) 1-10.

SUMMARY

The alloys described herein include 5000 series aluminum wrought alloys with high strength, excellent creep resistance, high corrosion resistance, good weldability, and high formability. For example, they can have mechanical strength comparable to commercial high-strength AA7039-T6 and AA7075-T6 alloys, the same or better corrosion resistance compared to commercial AA5083 alloy, and better creep resistance compared to commercial AA5083 alloy at a temperature range from about 25° C. to about 450° C. The alloys include about 3% to about 5% by weight magnesium, 0 to about 4% (and preferably about 0.1% to about 4%) by weight zinc, about 0.6% to about 1% by weight manganese, about 0.1% to about 0.3% by weight chromium, about 0.25% to about 0.8% (and preferably about 0.4% to about 0.8%) by weight zirconium, and aluminum as the remainder. Certain embodiments can further include scandium at a concentration of no more than about 0.15% (preferably between about 0.06% and about 0.14%, and more preferably between about 0.08% and about 0.12%) by weight. In certain embodiments the alloys lack scandium. Certain embodiments can further include copper at a concentration of no more than about 1% (and preferably between about 0.1% and about 1%) by weight. Also disclosed are aluminum cast articles incorporating aluminum alloys disclosed herein. The disclosed alloys are heat- and creep-resistant at temperatures as high as about 400° C. The alloy can be fabricated through processing methods used for rolled products such as continuous casting and twin-roll (or belt) casting. The disclosed alloys are age-hardened, and dispersion-hardened.

In certain embodiments the aluminum alloy can include about 3.5% to about 4% by weight magnesium and about 0.85% to about 1.2% by weight zinc.

In certain embodiments the aluminum alloy can include about 3.3% to about 4% by weight magnesium and about 3.5% to about 4.2% by weight zinc.

In certain embodiments the aluminum alloy can include about 3.5% to about 4% by weight magnesium, about 0.85% to about 1.2% by weight zinc, and about 0.5% to about 0.7% by weight zirconium.

In certain embodiments the aluminum alloy can include about 3.3% to about 4% by weight magnesium, about 3.5% to about 4.2% by weight zinc, and about 0.5% to about 0.7% by weight zirconium.

In certain embodiments the aluminum alloy can include about 3.5% to about 4% by weight magnesium, about 0.85% to about 1.2% by weight zinc, about 0.5% to about 0.7% by weight zirconium, and about 0.1% to about 1% by weight copper.

In certain embodiments the aluminum alloy can include about 3.3% to about 4% by weight magnesium, about 3.5% to about 4.2% by weight zinc, about 0.5% to about 0.7% by weight zirconium, and about 0.1% to about 1% by weight copper.

In certain embodiments the aluminum alloy can include about 3.5% to about 4% by weight magnesium, about 0.85% to about 1.2% by weight zinc, about 0.5% to about 0.7% by weight zirconium, and about 0.08% to about 0.12% by weight scandium.

In certain embodiments the aluminum alloy can include about 3.3% to about 4% by weight magnesium, about 3.5% to about 4.2% by weight zinc, about 0.5% to about 0.7% by weight zirconium, and about 0.08% to about 0.12% by weight scandium.

In certain embodiments the aluminum alloy can include about 3.5% to about 4% by weight magnesium, about 0.85% to about 1.2% by weight zinc, about 0.5% to about 0.7% by weight zirconium, about 0.08% to about 0.12% by weight scandium, and about 0.1% to about 1% by weight copper.

In certain embodiments the aluminum alloy can include about 3.3% to about 4% by weight magnesium, about 3.5% to about 4.2% by weight zinc, about 0.5% to about 0.7% by weight zirconium, about 0.08% to about 0.12% by weight scandium, and about 0.1% to about 1% by weight copper.

The disclosed alloys can be fabricated using low cost casting methods such as squeeze casting, twin-belt casting, twin-roll casting, and strip (bar) casting. Another advantage of these alloys is the relative low cost of raw materials used.

The room temperature high strength properties of the disclosed alloys are believed to be related to: i) maximizing the matrix strength through solid solution strengthening utilizing alloying elements such as magnesium, zinc, manganese, and chromium; ii) further strengthening the matrix through precipitation hardening. The precipitation hardening in the disclosed alloys is believed to be associated with: a) the precipitation of coherent $Al_3Zr$ and/or $Al_3(Sc_xZr_{1-x})$ ($0 \leq x \leq 1$) with $L1_2$ crystal structure and an average radius of no more than about 20 nm, such as in the range of 3-20 nm and with an average number density of no less than about $5 \times 10^{20}/m^3$; b) the precipitation of incoherent $Al_6Mn$ dispersoids with an average radius in the range of about 50 nm to about 200 nm; c) the precipitation of coherent Mg—Zn G. P. zones and intermediate phase (precursor of the equilibrium $MgZn_2$, so called η' or M' phase) in alloys with high Zn/Mg ratio, having an average radius of about 1 nm to about 5 nm; d) the precipitation of coherent Al—Mg—Zn G. P. zones and intermediate phase (precursor of the equilibrium $Mg_3Zn_3Al_2$, so called T' phase) in alloy with low Zn/Mg ratio, having an average radius of about 1 nm to about 5 nm; e) the precipitation of coherent $Al_2CuMg$ G. P. zones and intermediate phase, so called θ' in alloys with Cu content, having an average radius of about 1 nm to about 5 nm; and f) the formation of $Al_{12}Mn$, $Al_7Cr$ (or $Al_{45}Cr_7$) intermetallic phases in the range of about 50 nm to about 800 nm in size. The presence of intermetallic phases and nano-precipitates within the grains creates a strong pinning force against dislocation motions at ambient temperature.

The high strength and excellent creep resistance at elevated temperatures for the disclosed alloys are associated with the presence of: a) coherent heat- and coarsening-resistant $Al_3Zr$ and/or $Al_3(Sc_xZr_{1-x})$ ($0 \leq x \leq 1$) with $L1_2$ crystal structure and an average radius of no more than about 20 nm, such as in the range of 3-20 nm and with an average number density of no less than about $5 \times 10^{20}/m^3$; b) incoherent coarsening-resistant $Al_6Mn$ dispersoids with an average radius in the range of about 50 nm to about 200 nm; and c) heat-resistant $Al_{12}Mn$, $Al_7Cr$ (or $Al_{45}Cr_7$) intermetallic phases in the range of about 50 nm to about 800 nm in size. The presence of thermally-stable intermetallic phases and nano-precipitates within the grains create a strong pinning force against dislocation motions at elevated temperatures, which translates into higher strength and excellent creep resistance at elevated temperatures as high as about 400° C. (752° F.)

The disclosed aluminum alloys are also weldable by a gas welding method. The gas welding method can be metal inert gas (MIG) welding, tungsten inert gas (TIG) welding, or friction-stir welding.

Methods of manufacturing the alloys are also disclosed. The methods include casting at about 750° C. to about 950° C. (and preferably at about 800° C. to about 950° C.) an alloy mixture of, for example, about 3% to about 5% by weight magnesium, 0 to about 4% by weight zinc, about 0.6% to about 1% by weight manganese, about 0.1% to about 0.3% by weight chromium, about 0.3% to about 0.8% by weight zirconium, optionally up to about 1% by weight copper, optionally about 0.06% to about 0.14% by weight scandium, and aluminum as the remainder. The cast alloy is cooled down rapidly (or quenched) during solidification of the melt. The alloy can be aged at a temperature in the range of about 275° C. to about 475° C. for about 2 hours to about 72 hours (preferably in the range of about 350° C. to about 475° C. for about 24 hours to about 72 hours). The single- or double-step aged alloy can further be aged in an optional step aging at a temperature in the range of about 120° C. to about 220° C. for about 2 hours to about 48 hours (preferably about 120° C. to about 200° C. for about 8 hours to about 72 hours). A hot rolling step can be applied optionally after casting and before a heat treatment step. A cold rolling step can be applied optionally either before or after a heat treatment step to fabricate cast articles into shape.

In certain of the disclosed manufacturing methods the alloy mixture lacks scandium.

DETAILED DESCRIPTION OF INVENTION

Figure 1A:
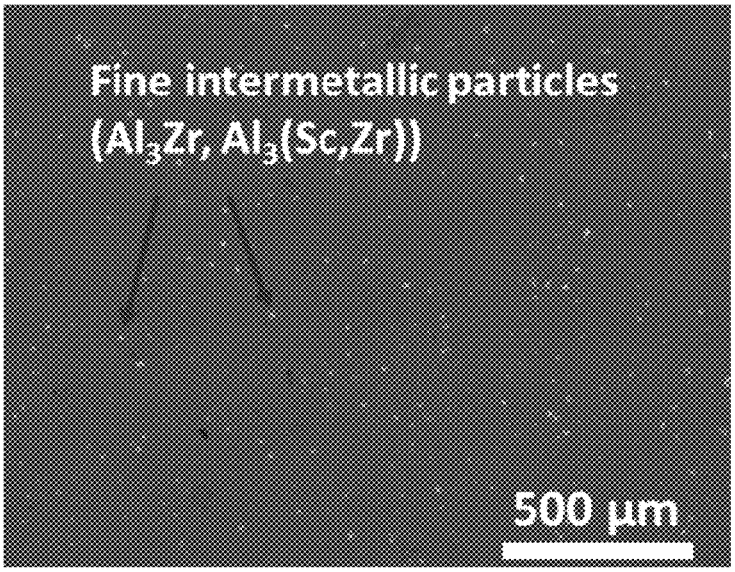
FIGS. 1A and 1B show scanning electron microscope images of the microstructure of an example alloy.

A series of high performance 5000 series aluminum wrought alloys with high strength, high formability, high corrosion resistance, and excellent creep resistance are disclosed.

The high strength at room temperature for the disclosed alloys is believed to related to: i) maximizing the matrix strength through solid solution strengthening utilizing alloying elements; and ii) further strengthening the matrix through dispersion hardening and precipitation hardening.

The solid solution strengthening in the disclosed alloys is associated with the alloying elements such as magnesium, zinc, chromium, manganese, and copper to create a solid-solution strengthening effect, and achieved through designed composition and specific heat treatment condition.

The precipitation hardening and dispersion hardening in the disclosed alloys are associated with: a) the precipitation of coherent $Al_3Zr$ and/or $Al_3(Sc_xZr_{1-x})$ ($0 \le x \le 1$) with $L1_2$ crystal structure and an average radius of no more than about 20 nm, such as in the range of 3-20 nm and with an average number density of no less than about $5\times10^{20}/m^3$; b) the precipitation of incoherent $Al_6Mn$ dispersoids with a an average radius in the range of about 50 nm to about 200 nm; c) the precipitation of coherent Mg—Zn G. P. zones and intermediate phase (precursor of the equilibrium $MgZn_2$, so called or η' or M' phase) in alloys with high Zn/Mg ratio, having an average radius of about 1 nm to about 5 nm; d) the precipitation of coherent Al—Mg—Zn G. P. zones and intermediate phase (precursor of the equilibrium $Mg_3Zn_3Al_2$, so called T' phase) in alloy with low Zn/Mg ratio, having an average radius of about 1 nm to about 5 nm; and e) the formation of $Al_{12}Mn$, $Al_7Cr$ (or $Al_{45}Cr_7$) intermetallic phases in the range of about 50 nm to about 800 nm in size. The presence of intermetallic phases and nano-precipitates within the grains impose a strong pinning effect against dislocation motions at ambient temperature.

The high strength and excellent creep resistance at elevated temperatures for the disclosed alloys are associated with the presence of: a) coherent coarsening-resistant $Al_3Zr$ and/or $Al_3(Sc_xZr_{1-x})$ ($0 \le x \le 1$) with $L1_2$ crystal structure and an average radius of no more than about 20 nm, such as in the range of 3-20 nm and with an average number density of no less than about $5\times10^{20}/m^3$; b) incoherent coarsening-resistant $Al_6Mn$ dispersoids with an average radius in the range of about 50 nm to about 200 nm; and c) $Al_{12}Mn$, $Al_7Cr$ (or $Al_{45}Cr_7$) intermetallic phases in the range of about 50 nm to about 800 nm in size. The presence of thermally-stable intermetallic phases and nano-precipitates within the grains create a strong pinning force against dislocation motions at elevated temperatures, which translates into higher strength at elevated temperatures as high as about 400° C. (752° F.) for long exposure times for the disclosed alloys.

Some of the advantages of the disclosed alloys are that they can be fabricated via low cost casting methods such as squeeze casting, twin-belt (roll) casting, and strip (bar) casting.

Another advantage of these alloys is the low cost of raw material, which results in a low alloy cost.

The presence of zinc and copper in the alloy results in formation of AlMgZn and $Al_2CuMg$ phases within the grains and prevents formation of continuous Al—Mg phase along grain boundaries. It leads to improved corrosion resistance of the disclosed alloys.

The high average number density of no less than about $5\times10^{20}/m^3$ of $Al_3Zr$ and/or $Al_3(Sc_xZr_{1-x})$ ($0 \le x \le 1$) nano-precipitates, having the $L1_2$ crystal structure and an average radius of no more than about 20 nm, such as in the range of 3-20 nm, is produced by super-saturation of the aluminum matrix solid solution from solutes through high cooling rates obtained from casting methods and subsequent precipitation. The presence of high cooling rates is necessary to obtain outstanding properties such as strength and creep resistance at ambient and elevated temperatures.

The disclosed 5000 aluminum alloys provide light weight, low cost, high strength, high creep and aging resistance, high corrosion resistance, and friction-stir weldability. These alloys are thermally stable, that is minimal drop in hardness after exposure for many hours, in the temperature range of about 25° C. to about 400° C.

The aforementioned properties are obtained, for example, for the disclosed alloys that contain:

about 3% to about 5% by weight magnesium,
about 0.5% to about 4% by weight zinc,
about 0.6% to about 1% by weight manganese,
about 0.1% to about 0.3% by weight chromium,
about 0.25% to about 0.8% by weight zirconium,
0 to about 0.15% by weight scandium,
Up to about 1% by weight copper, and
aluminum as the remainder.

The excellent creep resistance of the disclosed alloys results from two main strengthening mechanisms: the intermetallic dispersion hardening and nano-precipitation, which create barriers to dislocation motions (i.e. glide and climb mechanisms) at elevated temperatures.

Figure 1B:
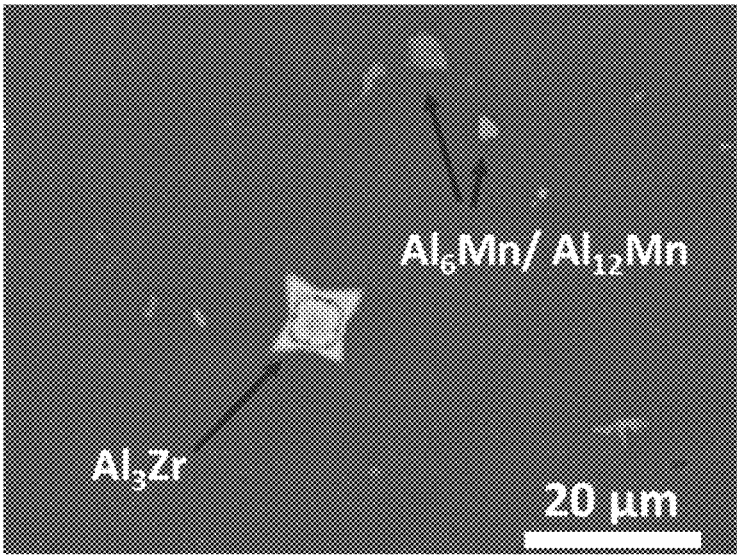

The intermetallic dispersion hardening relies on the formation of dispersed intermetallic phase within the grains during solidification and during heat treatment. About 0.6% to about 1% by weight manganese, about 0.1% to about 0.3% by weight chromium, about 0.25% to about 0.8% by weight zirconium, and about 0 to about 0.15% by weight scandium is utilized to form a fine dispersion of $Al_6Mn$, $Al_{12}Mn$, $Al_{45}Cr_7$, and $Al_3(Sc,Zr)$ intermetallic phases within the grains. These phases are formed during solidification and during subsequent heat treatment processes. The volume fraction and size of the intermetallic phase depends on the casting condition, solidification (cooling) rate, concentration of elements, and the specific heat treatment conditions. FIGS. 1A and 1B show a distribution of such intermetallic phases in a disclosed aluminum alloy (Al-4.3Mg-1.1Zn-0.8Mn-0.20Cr-0.7Zr % by weight). The microstructure is substantially homogenous with a fine uniform distribution of intermetallic particles $Al_3Zr$ (or $Al_3(Zr,Sc)$ if the alloy further includes scandium at a concentration of no more than about 0.15% by weight), $Al_6Mn$, and $Al_{12}Mn$ within the grains.

The nano-precipitation hardening relies on the formation of nano-precipitates in the aluminum matrix through specific heat treatment conditions. About 0.5% to about 4% by weight zinc, about 3.5% to about 5% by weight magnesium, up to about 1% by weight copper, about 0.25% to about 0.80% by weight zirconium, and 0 to about 0.15% by weight scandium create a high number density of nano-precipitates, in the order of about $5\times10^{20}$ $m^{-3}$ to about $9\times10^{21}$ $m^{-3}$, uniformly distributed in the matrix.

The nano-precipitates are in two categories: i) the low-temperatures nano-precipitates, thermally stable in the range of about 20° C. to about 180° C., consisting of coherent Mg—Zn G. P. zones and intermediate phase (precursor of the equilibrium $MgZn_2$, so called η' or M' phase) in alloys with high Zn/Mg ratio, having an average radius of about 1 nm to about 5 nm, and the precipitation of coherent Al—Mg—Zn G. P. zones and intermediate phase (precursor of the equilibrium $Mg_3Zn_3Al_2$, so called T' phase) in alloy with low Zn/Mg ratio, having an average radius of about 1 nm to about 5 nm; and ii) the high temperature nano-precipitates, thermally stable in the range of about 20° C. to about 400° C., consisting of coherent $Al_3Zr$ and/or $Al_3(Sc_xZr_{1-x})$ ($0\leq x\leq1$) with $L1_2$ crystal structure and an average radius of no more than about 20 nm, such as in the range of 3-20 nm and with an average number density of no less than about $5\times10^{20}/m^3$. The volume fraction, diameter, and lattice mismatch of $Al_3Zr$ and/or $Al_3(Sc_xZr_{1-x})$ ($0\leq x\leq1$) nano-precipitates depend on the concentration of Zr and Sc, and the specific heat treatment conditions.

The specific concentration of alloying elements and heat treatment conditions are necessary to create the desired microstructure with desired diameter and volume fraction of intermetallic phases and nano-precipitates. Generally, the disclosed alloys after optimal processing contain about 0.3% to about 0.8% by volume fraction $Al_3Zr$ and/or $Al_3(Sc_xZr_{1-x})$ ($0\leq x\leq1$) nano-precipitates.

To activate the strengtheners and achieve outstanding mechanical properties, the cast articles must have specific chemical compositions and heat treatments. These conditions are designed to maximize the strengthening effects through optimized formation of solid solution, nano-precipitates and intermetallic phases.

The high strength of disclosed alloys is achieved when using a T5 temper consisting of aging at about 350° C. to about 475° C. for about 24 hours to about 72 hours. The unique composition and the corresponding heat treatment allow nearly full precipitation of $Al_3Zr$ and/or $Al_3(Sc_xZr_{1-x})$ ($0\leq x\leq1$) nano-precipitates with high average number density of no less than about $5\times10^{20}/m^3$ and average radius of no more than about 20 nm, such as in the range of 3-20, while maintaining strength obtained through solid solution. The strength of invented alloys with specific composition and casting condition can be further increased by following an optional aging step. Following the first step aging at about 350° C. to about 475° C. for about 24 hours to about 72 hours, the optional step aging is conducted at temperatures about 120° C. to about 200° C. for about 8 hours to about 72 hours. The unique composition and the corresponding optional step aging allow uniform distribution of low-temperature nano-precipitates which results in higher strength. Table 1 shows a comparison of examples of presently disclosed alloys labeled M1 (Al-4.0Mg-4.0Zn-0.8Mn-0.20Cr-0.5Zr-0.1Sc % by weight) and M2 (Al-4.0Mg-4.0Zn-0.8Mn-0.20Cr-0.7Zr % by weight) with two commercial 5000 alloys, namely 5454 and 5083. The testing temperature for all alloys present in the table is at room temperature. The example alloys are aged to optimal condition prior to testing. The table shows significant improvement in mechanical properties of the disclosed alloys (i.e. strength, microhardness) compared to the commercial alloys.

TABLE 1

| Alloys | 5083 | M1 | 5454 | M2 |
|---|---|---|---|---|
| Temper | H34 | T5 | H34 | T5 |
| Yield (MPa) | 280 | 349* | 241 | 333* |
| UTS (MPa) | 345 | 554* | 303 | 524* |
| Ductility (%) | 7 | —** | 16 | —** |
| Hardness (HV) | 104 | 135 | 91 | 127 |
| Corrosion resistance | Good | Good | Good | Good |
| Friction-stir weldability | Good | Good | Good | Good |

*Values were measured in compression mode
**Values were not measured

Figure 2:
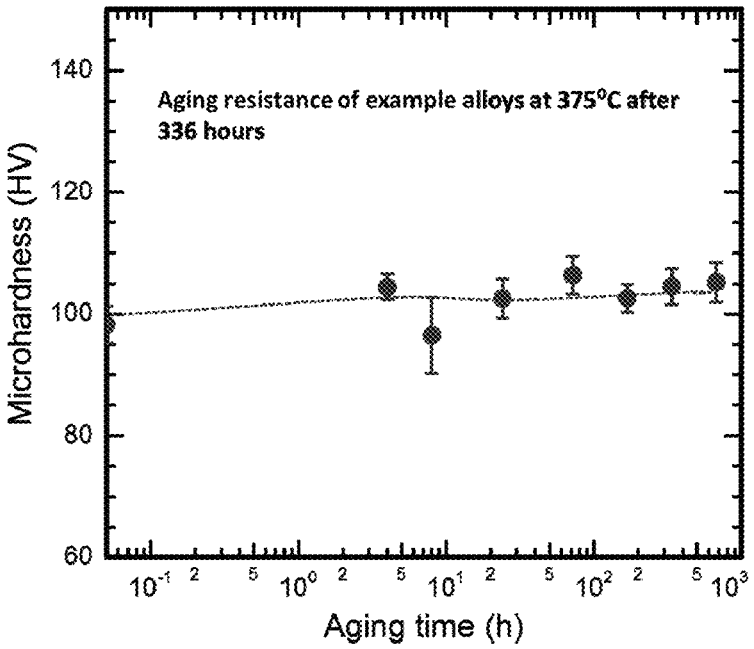
FIG. 2 graphs microhardness as a function of time for an example alloy aged at 375° C. for 14 days.

The thermal stability properties of the disclosed alloys is believed to be related to the presence of: a) thermally stable solid-solution strengthening; b) heat resistant $Al_3Zr$ and/or $Al_3(Sc_xZr_{1-x})$ ($0\leq x\leq1$) with $L1_2$ crystal structure and an average radius of no more than about 20 nm, such as in the range of 3-20 nm and with an average number density of no less than about $5\times10^{20}/m^3$; c) incoherent $Al_6Mn$ dispersoids with an average radius in the range of about 50 nm to about 200 nm; and d) incoherent $Al_{12}Mn$ and $Al_7Cr$ (or $Al_{45}Cr_7$) intermetallic phases in the range of about 50 nm to about 800 nm in size. The disclosed alloys are aging resistant up to about 400° C. The temperature range for aging resistance depends on the specific chemistry of the alloy and the heat treatment condition. Herein, the aging resistance is described as the retained room temperature strength after exposure to high temperature for 1000 hours. FIG. 2 shows the aging resistance of an example alloy (Al-4.3Mg-1.1Zn-08.Mn-0.20Cr-0.7Zr % by weight) at 375° C. The alloy is heat treated to optimum condition prior to exposure to 375° C. The results show no drop in microhardness values after exposure to 375° C. for two weeks.

The disclosed alloys may be produced in the form of plates through continuous casting routes such as twin-roll (twin-belt) casting. The high cooling rates (above about 50° C./s) achieved through these methods allow maximizing the content of solute atoms in the solid solution, which is crucial to obtain optimal mechanical properties after precipitation. The casting temperature is in the range of about 750° C. to about 950° C. (1382-1742° F.) (and preferably of about 800° C. to about 950° C.). After casting, the wrought product is aged at temperature in the range of about 350° C. to about 475° C. for about 24 hours to about 72 hours followed by optional aging at about 120° C. to about 200° C. for about 8 hours to about 72 hours to achieve optimal mechanical properties.

Figure 3:
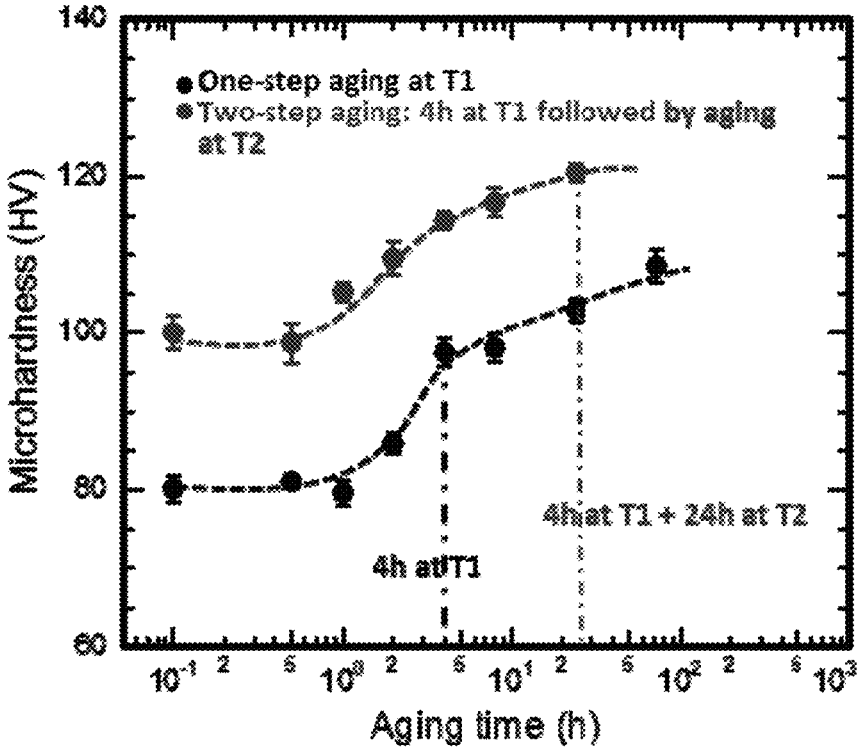
FIG. 3 illustrates the effect of one-step versus two step-aging at high temperature (temperature T1 or T2) in the range of 300-475° C. for an example alloy.

The disclosed alloys may be heat treated in one or two-step aging processes at high temperature. The two-step aging is performed on cast alloys to maximize room-temperature mechanical properties such as hardness, strength, ductility, and fracture toughness. While the first step aging at lower aging temperature creates a high number density of nuclei due to the higher chemical driving force, the second step aging at higher temperature accelerates the kinetics of precipitate growth to achieve optimal strength. For the one-step aging process, the cast article can be aged at temperature in the range of about 275° C. to about 475° C. for about 2 hours to about 72 hours (preferably in the range of about 350° C. to about 475° C. for about 24 hours to about 72 hours) to achieve optimal properties. For the two-step aging process, in the first step, the cast article can be aged at temperature range of about 330° C. to about 375° C. for about 2 hours to about 24 hours followed by the second step aging at about 425° C. to about 475° C. for about 1 hour to about 24 hours. The effect of two-step aging versus one-step aging is presented in FIG. 3 for an example disclosed alloy (Al-4.0Mg-1.0Zn-0.8Mn-0.20Cr-0.5Zr-0.1Sc % by weight, with T1=300° C. and T2=400° C.). A noticeable increase in microhardness values is observed for the alloy aged by the two-step aging process.

Figure 4:
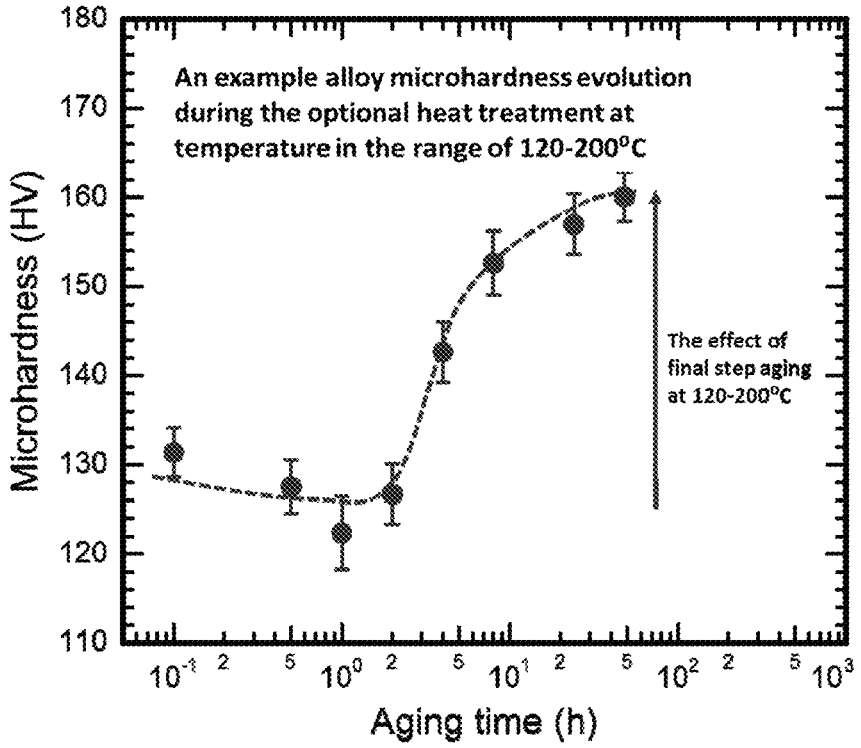
FIG. 4 shows the effect of an optional low temperature aging step on the microhardness of an example alloy.

The disclosed alloys alloy can be further heat treated optimally at low-temperature after the high temperature one-step or two-step aging process. The heat treatment will be conducted at low-temperatures in the range of about 120° C. to about 200° C. for about 8 hours to about 72 hours. This optional step-aging at low temperature is to further improve the corrosion resistance and mechanical properties such as hardness, strength, ductility, and fracture toughness. The effect of the optional aging step for an example disclosed alloy (Al-4.0Mg-4.0Zn-0.8Mn-0.20Cr-0.7Zr by weight) is presented in FIG. 4. For this alloy, the microhardness is increased more than 24% after aging for about 24 hours to about 48 hours at an aging temperature in the range of about 120° C. to about 200° C. Also Table 2 shows the effect of the optional step aging on the example alloy M2. The properties of two high strength 7000 commercial alloys, namely AA7039 and AA7075, are presented for comparison. The microhardness of the alloy was increase from 127 HV to 157 HV, a 24% improvement after final step aging.

TABLE 2

| Alloys | M2 | 7039 | 7075 |
|---|---|---|---|
| Temper | T6 | T64 | T651 |
| Yield (MPa) | 408* | 380 | 503 |
| UTS (MPa) | 546* | 450 | 572 |
| Ductility (%) | —** | 13 | 9 |
| Hardness (HV) | 157 | 153 | 175 |
| Corrosion resistance | Good | Bad | Bad |
| Friction-stir weldability | Good | Bad | Bad |

*Values were measured in compression mode
**Values were not measured

A disclosed aluminum magnesium alloy has high strength at room and elevated temperatures, high creep resistance, high corrosion resistance, and good weldability, and comprises:

about 3% to about 5% by weight magnesium,
about 0 to about 4% by weight zinc,
about 0.6 to about 1% by weight manganese,
about 0.1% to about 0.3% by weight chromium,
about 0.25% to about 0.8% by weight zirconium, and
aluminum as the remainder.

A disclosed alloy can further comprise scandium at a concentration of up to about 0.15% by weight.

A disclosed alloy can further comprise copper at a concentration of up to about 1% by weight.

In certain embodiments the disclosed alloys lack scandium.

A disclosed alloy can further comprise about 3.5% to about 4% by weight magnesium and about 0.85% to about 1.2% by weight zinc.

A disclosed alloy can further comprise about 3.3% to about 4% by weight magnesium and about 3.5% to about 4.2% by weight zinc.

A disclosed alloy can further comprise about 3.5% to about 4% by weight magnesium, about 0.85% to about 1.2% by weight zinc, and about 0.5% to about 0.7% by weight zirconium.

A disclosed alloy can further comprise about 3.3% to about 4% by weight magnesium, about 3.5% to about 4.2% by weight zinc, and about 0.5% to about 0.7% by weight zirconium.

A disclosed alloy can further comprise about 3.5% to about 4% by weight magnesium, about 0.85% to about 1.2% by weight zinc, about 0.5% to about 0.7% by weight zirconium, and about 0.1% to about 1% by weight copper.

A disclosed alloy can further comprise about 3.3% to about 4% by weight magnesium, about 3.5% to about 4.2% by weight zinc, about 0.5% to about 0.7% by weight zirconium, and about 0.1% to about 1% by weight copper.

A disclosed alloy can further comprise about 3.5% to about 4% by weight magnesium, about 0.85% to about 1.2% by weight zinc, about 0.5% to about 0.7% by weight zirconium, and about 0.08% to about 0.12% by weight scandium.

A disclosed alloy can further comprise about 3.3% to about 4% by weight magnesium, about 3.5% to about 4.2% by weight zinc, about 0.5% to about 0.7% by weight zirconium, and about 0.08% to about 0.12% by weight scandium.

A disclosed alloy can further comprise about 3.5% to about 4% by weight magnesium, about 0.85% to about 1.2% by weight zinc, about 0.5% to about 0.7% by weight zirconium, about 0.08% to about 0.12% by weight scandium, and about 0.1% to about 1% by weight copper.

A disclosed alloy can further comprise about 3.3% to about 4% by weight magnesium, about 3.5% to about 4.2% by weight zinc, about 0.5% to about 0.7% by weight zirconium, about 0.08% to about 0.12% by weight scandium, and about 0.1% to about 1% by weight copper.

A disclosed alloy can comprise a dispersion of coherent $Al_3Zr$ and/or $Al_3(Sc_xZr_{1-x})$ ($0 \leq x \leq 1$) with $L1_2$ crystal structure with an average radius of no more than about 20 nm, such as in the range of 3-20 nm and with an average number density of no less than about $5 \times 10^{20}/m^3$.

A disclosed alloy can comprise a dispersion of the incoherent $Al_6Mn$ dispersoids with an average radius in the range of about 50 nm to about 200 nm.

A disclosed alloy can comprise a dispersion of coherent Mg—Zn G. P. zones and intermediate phase (precursor of the equilibrium $MgZn_2$, so called η' or M' phase) in alloys with high Zn/Mg ratio, having an average radius of about 1 nm to about 5 nm.

A disclosed alloy can comprise a dispersion of coherent Al—Mg—Zn G. P. zones and intermediate phase (precursor of the equilibrium $Mg_3Zn_3Al_2$, so called T' phase) in alloy with low Zn/Mg ratio, having an average radius of about 1 nm to about 5 nm.

A disclosed alloy can comprise a dispersion of $Al_{12}Mn$, $Al_7Cr$ (or $Al_{45}Cr_7$) intermetallic phases in the range of about 50 nm to about 800 nm in size.

A disclosed alloy can comprise a dispersion of coherent $Al_2CuMg$ G. P. zones and intermediate phase, so called θ' in alloys with Cu content, having an average radius of about 1 nm to about 5 nm.

A disclosed alloy can comprise a dispersion of coherent $Al_3Zr$ and/or $Al_3(Sc_xZr_{1-x})$ ($0 \le x \le 1$) with $L1_2$ crystal structure with an average radius of no more than about 20 nm, such as in the range of 3-20 nm and with an average number density of no less than about $5 \times 10^{20}/m^3$, a dispersion of the incoherent $Al_6Mn$ dispersoids with an average radius in the range of about 50 nm to about 200 nm, and a dispersion of $Al_{12}Mn$, $Al_7Cr$ (or $Al_{45}Cr_7$) intermetallic phases in the range of about 50 nm to about 800 nm in size.

A disclosed alloy can comprise a dispersion of coherent $Al_3Zr$ and/or $Al_3(Sc_xZr_{1-x})$ ($0 \le x \le 1$) with $L1_2$ crystal structure with an average radius of no more than about 20 nm, such as in the range of 3-20 nm and with an average number density of no less than about $5 \times 10^{20}/m^3$, a dispersion of the incoherent $Al_6Mn$ dispersoids with an average radius in the range of about 50 nm to about 200 nm, a dispersion of $Al_{12}Mn$, $Al_7Cr$ (or $Al_{45}Cr_7$) intermetallic phases in the range of about 50 nm to about 800 nm in size, and a dispersion of coherent Mg—Zn G. P. zones and intermediate phase (precursor of the equilibrium $MgZn_2$, η' or M' phase) in alloys with high Zn/Mg ratio, having an average radius of about 1 nm to about 5 nm.

A disclosed alloy can comprise a dispersion of coherent $Al_3Zr$ and/or $Al_3(Sc_xZr_{1-x})$ ($0 \le x \le 1$) with $L1_2$ crystal structure with an average radius of no more than about 20 nm, such as in the range of 3-20 nm and with an average number density of no less than about $5 \times 10^{20}/m^3$, a dispersion of the incoherent $Al_6Mn$ dispersoids with an average radius in the range of about 50 nm to about 200 nm, a dispersion of $Al_{12}Mn$, $Al_7Cr$ (or $Al_{45}Cr_7$) intermetallic phases in the range of about 50 nm to about 800 nm in size, and a dispersion of coherent Al—Mg—Zn G. P. zones and intermediate phase (precursor of the equilibrium $Mg_3Zn_3Al_2$, T' phase) in alloy with low Zn/Mg ratio, having an average radius of about 1 nm to about 5 nm.

A disclosed alloy can comprise copper at the concentration up to about 1% by weight and a dispersion of coherent $Al_3Zr$ and/or $Al_3(Sc_xZr_{1-x})$ ($0 \le x \le 1$) with $L1_2$ crystal structure with an average radius of no more than about 20 nm, such as in the range of 3-20 nm and with an average number density of no less than about $5 \times 10^{20}/m^3$, a dispersion of the incoherent $Al_6Mn$ dispersoids with an average radius in the range of about 50 nm to about 200 nm, a dispersion of $Al_{12}Mn$, $Al_7Cr$ (or $Al_{45}Cr_7$) intermetallic phases in the range of about 50 nm to about 800 nm in size, a dispersion of coherent Mg—Zn G. P. zones and intermediate phase (precursor of the equilibrium $MgZn_2$, η' or M' phase) in alloys with high Zn/Mg ratio, having an average radius of about 1 nm to about 5 nm, and a dispersion of coherent $Al_2CuMg$ G. P. zones and intermediate phase, θ' in alloys with Cu content, having an average radius of about 1 nm to about 5 nm.

A disclosed alloy can further comprise copper at a the concentration up to about 1% by weight and a dispersion of coherent $Al_3Zr$ and/or $Al_3(Sc_xZr_{1-x})$ ($0 \le x \le 1$) with $L1_2$ crystal structure with an average radius of no more than about 20 nm, such as in the range of 3-20 nm and with an average number density of no less than about $5 \times 10^{20}/m^3$, a dispersion of the incoherent $Al_5Mn$ dispersoids with an average radius in the range of about 50 nm to about 200 nm, a dispersion of $Al_{12}Mn$, $Al_7Cr$ (or $Al_{45}Cr_7$) intermetallic phases in the range of about 50 nm to about 800 nm in size, a dispersion of coherent Al—Mg—Zn G. P. zones and intermediate phase (precursor of the equilibrium $Mg_3Zn_3Al_2$, T' phase) in alloy with low Zn/Mg ratio, having an average radius of about 1 nm to about 5 nm, and a dispersion of coherent $Al_2CuMg$ G. P. zones and intermediate phase, so called θ' in alloys with Cu content, having an average radius of about 1 nm to about 5 nm.

Disclosed aluminum alloys may be used to form cast aluminum articles.

A disclosed method for manufacturing a cast aluminum alloy comprises casting an aluminum alloy comprising about 3% to about 5% by weight magnesium,
about 0 to about 4% by weight zinc,
about 0.6% to about 1% by weight manganese,
about 0.1% to about 0.3% by weight chromium,
about 0.25% to about 0.8% by weight zirconium, and
aluminum as the remainder; and using a casting method selected from the group of casting methods consisting of squeeze casting, twin-belt casting, twin-roll casting, and strip (bar) casting.

A disclosed method for manufacturing an aluminum alloy comprises the steps of melting at about 750° C. to about 950° C. (and preferably at about 800° C. to about 950° C.) an alloy mixture comprising:

about 3% to 5% by weight magnesium,
about 0 to about 4% by weight zinc,
about 0.6% to about 1% by weight manganese,
about 0.1% to about 0.3% by weight chromium,
about 0.25% to about 0.8% by weight zirconium,
optionally up to about 0.15% by weight scandium,
optionally up to about 1% by weight copper,
and aluminum as the remainder; with cooling rates of more than about 50° C./s from melt temperature down to about 300° C.; and aging the cast article at a temperature in the range of about 275° C. to about 475° C. for about 2 hours to about 72 hours (preferably in the range of about 350° C. to about 475° C. for about 24 hours to about 72 hours) is disclosed.

A disclosed method for manufacturing an aluminum alloy can include aging at about 350° C. to about 475° C. for about 2 hours to about 72 hours.

A disclosed method for manufacturing an aluminum alloy can include a two-step aging process of aging at about 275° C. to about 375° C. for about 2 hours to about 24 hours, followed by aging at about 425° C. to about 475° C. for about 1 hour to about 24 hours.

A disclosed method for manufacturing an aluminum alloy optionally can include additional lower temperature aging after the higher temperature aging. The additional lower temperature aging comprises aging at about 120° C. to about 200° C. for about 8 hours to about 72 hours.

A disclosed method for manufacturing an aluminum alloy can be as described above wherein the alloy lacks scandium.

The present invention has been described in detailed embodiments thereof. It is understood by those skilled in the art that modifications and variations in this detail may be made without departing from the spirit and scope of the claimed invention.

It is to be understood that no limitation with respect to the specific embodiments illustrated and described is intended or should be inferred.

What is claimed is:

1. An aluminum alloy comprising:

about 3% to about 5% by weight magnesium;
about 0.1% to about 4% by weight zinc;
about 0.6% to about 1% by weight manganese;
about 0.1% to about 0.3% by weight chromium;
about 0.4% to about 0.8% by weight zirconium;
aluminum as the remainder; and
a dispersion of coherent $Al_3Zr$ nanoscale precipitates with an $L1_2$ crystal structure in an aluminum matrix, the $Al_3Zr$ nanoscale precipitates having an average radius of no more than about 20 nm and having an average number density of no less than about $5\times10^{20}$ per $m^3$.

2. The aluminum alloy of claim 1, further comprising scandium at a concentration of no more than about 0.15% by weight.

3. The aluminum alloy of claim 1, further comprising copper at a concentration of no more than about 1% by weight.

4. The aluminum alloy of claim 1, further comprising a dispersion of the incoherent $Al_6Mn$ dispersoids having an average radius in the range of about 50 nm to about 200 nm.

5. The aluminum alloy of claim 1, further comprising a dispersion of $Al_{12}Mn$, $Al_7Cr$ or $Al_{45}Cr_7$ intermetallic phases in the range of about 50 nm to about 800 nm in size.

6. The aluminum alloy of claim 5, further comprising a dispersion of the incoherent $Al_6Mn$ dispersoids having an average radius in the range of about 50 nm to about 200 nm.

7. The aluminum alloy of claim 1, wherein the alloy has mechanical strength comparable to commercial high-strength AA7039-T6 and AA7075-T6 alloys.

8. The aluminum alloy of claim 1, wherein the alloy has the same or better corrosion resistance compared to commercial AA5083 alloy.

9. The aluminum alloy of claim 1, wherein the alloy has better creep resistance compared to commercial AA5083 alloy at a temperature range from about 25° C. to about 450° C.

10. The aluminum alloy of claim 1, wherein the alloy is weldable by a gas welding method.

11. The aluminum alloy of claim 10, wherein the gas welding method is selected from a group consisting of Metal Inert Gas (MIG) welding, Tungsten Inert Gas (TIG) welding, and friction-stir welding.

12. The aluminum alloy of claim 1, wherein the alloy maintains high room temperature strength after exposure at about 375° C. for at least about two weeks.

13. The aluminum alloy of claim 1, wherein the alloy comprises about 3.5% to 4% by weight magnesium and about 0.85% to 1.2% by weight zinc.

14. The aluminum alloy of claim 13, wherein the alloy further comprises about 0.5% to about 0.7% by weight zirconium.

15. The aluminum alloy of claim 14, further comprising about 0.1% to about 1% by weight copper.

16. The aluminum alloy of claim 14, further comprising about 0.08% to about 0.12% by weight scandium.

17. The aluminum alloy of claim 16, further comprising about 0.1% to about 1% by weight copper.

18. The aluminum alloy of claim 1, wherein the alloy further comprises about 3.3% to about 4% by weight magnesium and about 3.5% to about 4.2% by weight zinc.

19. The aluminum alloy of claim 18, wherein the alloy further comprises about 0.5% to about 0.7% by weight zirconium.

20. The aluminum alloy of claim 19, further comprising about 0.1% to about 1% by weight copper.

21. The aluminum alloy of claim 19, further comprising about 0.08% to about 0.12% by weight scandium.

22. The aluminum alloy of claim 21, further comprising about 0.1% to about 1% by weight copper.

23. A method of making the aluminum alloy of claim 1, the method comprising:

melting an alloy mixture in a temperature range of about 750° C. to about 950° C.;

casting the melted alloy mixture with a high solidification cooling rate that is above about 50° C./s; and after the casting step, aging the cast alloy at a temperature in a range of about 275° C. to about 475° C. for about 2 hours to about 72 hours.

24. The method of claim 23, wherein the aging step comprises aging the cast alloy at a temperature in a range of about 350° C. to about 475° C. for about 2 hours to about 72 hours.

25. The method of claim 23, wherein the aging step comprises:

aging the cast alloy at a temperature in a range of about 275° C. to about 375° C. for about 2 hours to about 24 hours; and then aging the cast alloy at a temperature in a range of about 375° C. to about 475° C. for about 1 hour to about 24 hours.

26. The method of claim 23, wherein the aging step comprises aging the cast alloy at a temperature in a range of about 350° C. to about 475° C. for about 24 hours to about 72 hours.

27. The method of claim 23, wherein the casting step is performed using a casting method selected from a group consisting of squeeze casting, twin-belt casting, twin-roll casting, strip casting, and bar casting.

28. The method of claim 23, further comprising hot rolling the cast alloy after the casting step and before aging step.

29. The method of claim 23, further comprising cold rolling the cast alloy either before or after the aging step to fabricate cast articles into shape.

30. The method of claim 23, further comprising: after the aging step, additionally aging the cast alloy at a temperature in a range of about 120° C. to about 200° C. for about 8 hours to about 72 hours.

31. A cast aluminum component comprising the alloy of claim 1.

32. The aluminum component of claim 31, the component being selected from a group consisting of automotive body panels, boat or ship body structures, storage tanks, pressure vessels, and vessels for land or marine structures.

* * * * *